United States Patent [19]

McDonald

[11] 4,126,213

[45] Nov. 21, 1978

[54] COLLAPSIBLE SUITCASE

[76] Inventor: William G. McDonald, 307 E. 162nd St., Bronx, N.Y. 10456

[21] Appl. No.: 820,309

[22] Filed: Jul. 29, 1977

[51] Int. Cl.[2] ..... B65D 5/14

[52] U.S. Cl. ..... 190/18 A; 190/41 Z; 190/43; 190/44

[58] Field of Search ..... 190/41 Z, 43, 44, 18 A; 312/3, 6; 150/48, 49, 50

[56] References Cited

U.S. PATENT DOCUMENTS

| | | | |
|---|---|---|---|
| 1,629,362 | 5/1927 | Robert | 190/43 X |
| 2,016,520 | 10/1935 | Short | 190/41 Z X |
| 2,170,379 | 8/1939 | Ortt | 190/43 |
| 2,254,578 | 9/1941 | O'Brien | 190/43 |
| 2,710,084 | 6/1955 | Braverman | 190/43 |
| 2,768,719 | 10/1956 | Samuel | 190/43 |
| 3,895,696 | 7/1975 | Urushibara | 190/18 A X |

*Primary Examiner*—Donald F. Norton
*Attorney, Agent, or Firm*—Posnack, Roberts, Cohen & Spiecens

[57] ABSTRACT

A collapsible suitcase wherein a bottom member has side walls foldably secured thereto with slide fasteners connecting each side wall to form a box-like enclosure. The pull rings of the slide fasteners are locked in closed position by a latch on each corner of an attachable top. The actual volume of the case can be varied according to the extent the slide fasteners are zippered. Rollers are mounted under the bottom of the case to facilitate transport.

4 Claims, 4 Drawing Figures

COLLAPSIBLE SUITCASE

FIELD OF THE INVENTION

This invention relates to a size-adjustable case having individually accessible sides so that it may be used for transporting or displaying its contents and collapsed to a much decreased size for storage purposes.

THE PRIOR ART:

With increased travel, devices of this type are becoming extremely popular and are receiving widespread attention and acceptance.

The prior art as exemplified by U.S. Pat. Nos. 3,335,826; 3,221,848; 3,228,738; 3,342,535; and 2,416,783 is generally illustrative of various devices of this type. While such devices are generally acceptable for their intended purpose, they have not proven to be entirely satisfactory in that they are either complex and expensive to manufacture, or bulky and inconvenient to use, or require unusual skill and/or dexterity typified by the above, there has developed and continues to exist a substantial need for devices of the character described. Despite this need, and the efforts of many individuals and companies to develop such devices, a satisfactory device meeting this need has heretofore been unavailable.

The principal object of this invention is to provide a device or article of this character which combines simplicity, strength and durability in a high degree, together with inexpensiveness of construction.

Other objects of this invention will in part be obvious and in part hereinafter pointed out.

The invention accordingly consists in the features of construction, combinations of elements, and arrangement of parts which will be exemplified in the construction hereinafter described, and of which the scope of application will be indicated in the following claims.

BRIEF DESCRIPTION OF THE DRAWINGS:

In the accompanying drawing, in which is shown one of the various possible illustrative embodiments of this invention, wherein like reference character identify the same or like parts.

Figure 1:
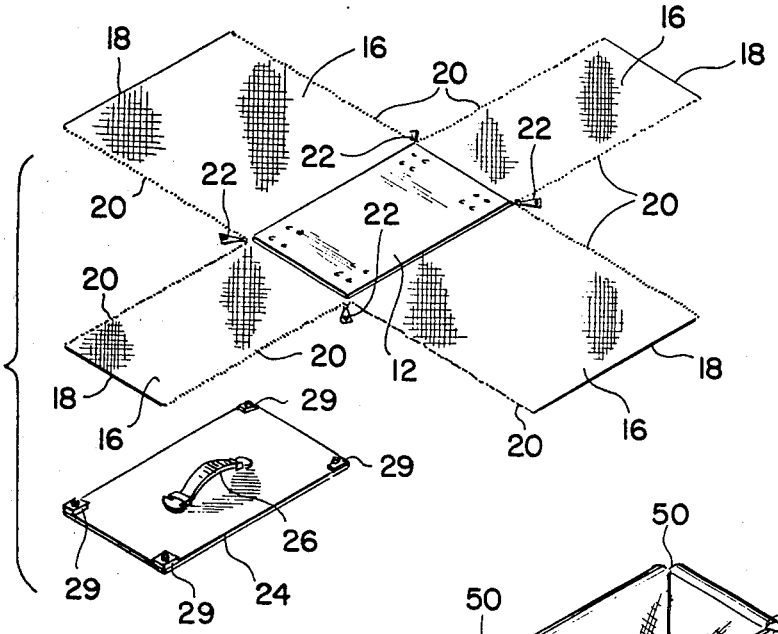
FIG. 1 is a perspective view of the case of the invention shown with the slide fasteners open and the top separate.

DESCRIPTION OF THE PREFERRED EMBODIMENT:

With reference to the drawing, there is shown and illustrated a COLLAPSIBLE SUITCASE constructed in accordance with the principles of the invention and designated generally by reference character 10.

The suitcase of the invention includes a bottom or base member 12 formed of rigid material such as plastic or light metal or fabric-covered wood. Secured to the corners of the base 12 are rollers 14. Secured to the sides of base 12 by stitching, gluing or otherwise, are four panels 16 of foldable fabric, leather or plastic material. As shown in FIG. 1, one end of the panels is secured to the edge of the base 12 and its opposite end 18 is free. Each side of the panels between these ends has a slide fastener track 20 cooperating with a similar track in register therewith but secured on the adjoining panel. A slider 22 connects the sides together to form a box-like structure along with base 12 as shown in FIG. 2.

An attachable top member 24, of the same material and shape as base 12, has a handle 26 fixed in suitable manner to its top surface. On its underside may be mounted a support bar 28 to hold clothes hangers.

Figure 4:
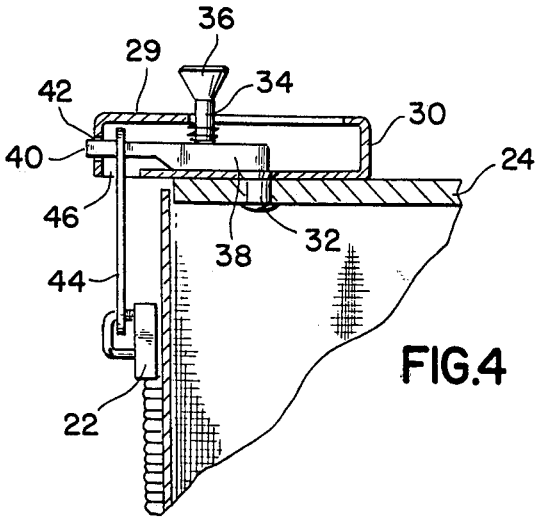
FIG. 4 is a detailed view taken along line IV—IV of FIG. 3 and showing one type of latch means for securing the top to the sides of the case.

As shown in FIG. 4, a latch mechanism 29 extends beyond each corner of top 24. The mechanism comprises a hollow bracket member 30, fastened for example by rivets to the top at 32 and having an upper slot through which actuating pin 34 is moved longitudinally by button 36. Pin 34 is rigid with slider 38 whose latch end 40 protrudes through opening 42 at the end of the bracket after passing through pull ring 44 secured to slider 22 of the slide fastener. A slit 46 is provided in the bottom of the part of bracket 30 which extends beyond the sides of the fasteners.

Figure 2:
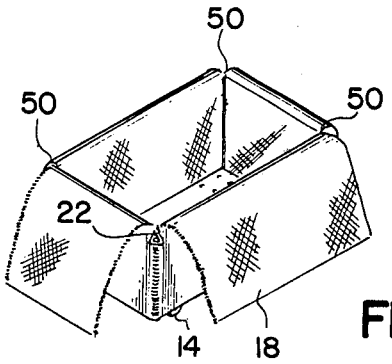
FIG. 2 is a perspective view of the same shown partly closed.
Figure 3:
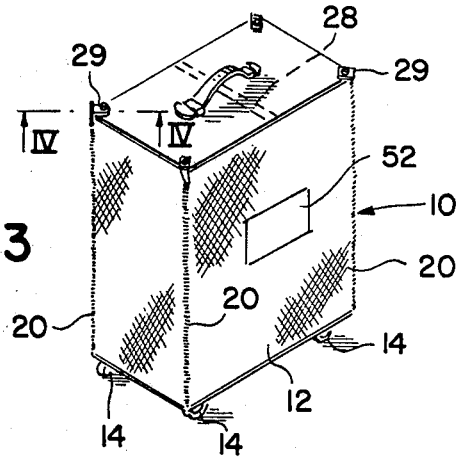
FIG. 3 is a perspective view of the fully assembled case.

By referring to FIG. 2, it will be appreciated that top 24 may be attached to the assembly at any stage by simply folding the unzippered portions of the four sides inside the box-like structure formed by the zippered portion and base 12 and then securing top 24 to the pull rings 44 as shown in FIG. 4.

It will be appreciated also that to gain access to the contents of case 10, it is not necessary to remove top 24 but merely to unzipper one of the sides. This is advantageous to reach items in a hurry at, for example, customs examinations. Telescopic or fixed support bars so which are removable and storable in the folded case can be provided to form a rigid assembly. Thus a display case can be formed by unzippering one side only with the rest of the assembly held upright by the four bars.

Side pockets 52 can be mounted, if desired, on the outside of the case. In a modification, the top of the case may be integral with the sides and the bottom made removable by reversing the described construction.

The operation and use of the invention hereinabove described will be evident to those skilled in the art to which it relates from a consideration of the foregoing.

It will thus be seen that there is provided a carrying device in which the several objects of this invention are achieved, and which is well adapted to meet the conditions of practical use.

It is thought that persons skilled in the art to which this invention relates will be able to obtain a clear understanding of the invention after considering the foregoing description in connection with the accompanying drawing. Therefore, a more lengthy description is deemed unnecessary.

It is to be understood that various changes in shape, size and arrangement of the elements of this invention as claimed may be restored to in actual practice, if desired.

Having thus described the invention, what is claimed as new and to be secured by Letters Patent is:

1. A collapsible case of adjustable size comprising, in combination, a rigid member, a plurality of adjoining flexible panels having one end secured to said rigid member and an opposite free end; each panel having slide fastener tracks between said ends cooperating with slide fasteners on the adjoining panels, a slider connecting fasteners on adjoining panels for zippering said panels together to form with said end member a box-like structure; and an attachable closure having a plurality of individual latch means for securing to each slider to form a closed structure of a size dependent on the length of said fasteners zippered by said sliders.

2. The invention as recited in claim 1, further including rollers mounted under said rigid member and a handle mounted on said closure.

3. The invention as recited in claim 2, further including a support bar for clothes hangers and mounted on said closure under said handle.

4. The invention as recited in claim 1, wherein at least one of said panels has a pocket secured to the outside thereof.

* * * * *